US008757042B2

(12) United States Patent
Pfister

(10) Patent No.: US 8,757,042 B2
(45) Date of Patent: Jun. 24, 2014

(54) ARMOR MOUNTING SYSTEM

(75) Inventor: Karl Gerhard Pfister, Thorndale (CA)

(73) Assignee: 2040422 Ontario Inc., Dorchester, Ontario (CA)

( * ) Notice: Subject to any disclaimer, the term of this patent is extended or adjusted under 35 U.S.C. 154(b) by 52 days.

(21) Appl. No.: 11/916,354

(22) PCT Filed: Sep. 12, 2005

(86) PCT No.: PCT/CA2005/001396
§ 371 (c)(1),
(2), (4) Date: Nov. 7, 2008

(87) PCT Pub. No.: WO2006/128271
PCT Pub. Date: Dec. 7, 2006

(65) Prior Publication Data

US 2009/0133571 A1 May 28, 2009

(30) Foreign Application Priority Data

Jun. 3, 2005 (CA) ..... 2509095

(51) Int. Cl.
*F41H 7/00* (2006.01)

(52) U.S. Cl.
USPC ..... 89/36.07; 89/36.01; 89/36.04

(58) Field of Classification Search
USPC ..... 89/36.01, 36.04, 36.07–36.09, 89/36.11–36.12, 937; 403/375–376; 52/506.05–506.06, 511–512
See application file for complete search history.

(56) References Cited

U.S. PATENT DOCUMENTS

| | | | | | |
|---|---|---|---|---|---|
| 1,086,980 | A | * | 2/1914 | Badcock | 411/299 |
| 4,167,889 | A | * | 9/1979 | Bohne et al. | 89/36.02 |
| H0000129 | H | * | 9/1986 | Hansen | 89/36.04 |
| 4,716,810 | A | * | 1/1988 | DeGuvera | 89/36.02 |
| 4,833,968 | A | * | 5/1989 | Bohne et al. | 89/36.08 |
| 4,961,368 | A | | 10/1990 | Hartmann | |
| 5,033,357 | A | * | 7/1991 | Seksaria et al. | 89/36.04 |
| 5,704,100 | A | * | 1/1998 | Swan | 24/656 |
| 5,792,974 | A | | 8/1998 | Daqis et al. | |
| 6,082,240 | A | * | 7/2000 | Middione et al. | 89/36.08 |

(Continued)

FOREIGN PATENT DOCUMENTS

| | | | |
|---|---|---|---|
| DE | 202004010626 | U1 | 1/2005 |
| EP | 0-271-048 | A2 | 6/1988 |
| GB | 2280252 | | 1/1995 |

OTHER PUBLICATIONS

Definition of "within". Collins English Dictionary—Complete and Unabridged © HarperCollins Publishers 1991, 1994, 1998, 2000, 2003.*

*Primary Examiner* — Gabriel Klein

(57) ABSTRACT

A system for mounting armor to a structure such as a vehicle hull has a base for attachment to the structure, an adapter engaged with the base and with the armor for coupling the base to the armor, and a fastener, for example a pin or a bolt) for rigidly securing the adapter with the base. The system advantageously permits retrofitting of previously unarmored structures and/or permits replacement of damaged or obsolete armor. A kit for retrofitting a structure with armor has a base for attachment to the structure, an adapter for engagement with the base and with the armor for coupling the base to the armor, a fastener for rigidly engaging the adapter with the base, and instructions for mounting the armor on the structure using the base, the adapter and the fastener.

11 Claims, 10 Drawing Sheets

(56) References Cited

U.S. PATENT DOCUMENTS 6,735,921 B2 * 5/2004 Oberhofer et al. ..... 52/786.1
7,490,539 B2 * 2/2009 Ma ..... 89/36.02
7,770,506 B2 * 8/2010 Johnson et al. ..... 89/36.09
2004/0083879 A1 * 5/2004 Benyami et al. ..... 89/36.02
2007/0234895 A1 * 10/2007 Singh et al. ..... 89/36.07

* cited by examiner

ARMOR MOUNTING SYSTEM

FIELD OF THE INVENTION

This invention relates to a system for mounting armor on a structure, particularly for mounting armor on a vehicle.

BACKGROUND OF THE INVENTION

Structures, in particular vehicles, may be provided with ballistic protection by armor. Armored vehicles may be originally manufactured with armor protection integrated into the structure, however, the need to replace the armor due to damage or differing operational requirements of the vehicle is made difficult by such integrated armor. Furthermore, it is often desirable to retrofit previously unarmored vehicles with armor. It is therefore desirable in the art to provide a system for mounting armor on a structure, for example a vehicle, which permits easy replacement of armor and which permits retrofitting of previously unarmored vehicles.

There are a variety of kinds of armor that may be used to protect structures such as vehicles, for example, composite armor and spaced metallic armor. It is desirable to have a mounting system that has the versatility to mount more than one kind of armor on a structure.

Thus, there is a need in the art for a versatile armor mounting system that permits replacement of armor on structures and/or permits retrofitting of previously unarmored structures.

SUMMARY OF THE INVENTION

In one aspect of the invention, there is provided armor mounted to a structure by a mounting system, the armor comprising an anti-penetration layer having a front face uninterrupted by the mounting system to thereby reduce ballistic window of the armor.

In another aspect of the invention, there is provided armor comprising a front face, a rear face and a mounting system for mounting the armor on a structure, the mounting system comprising an adapter disposed between the front and rear faces.

In yet another aspect of the invention, there is provided a system for mounting armor to a structure comprising: a base for attachment to the structure; an adapter engaged with the base and with the armor for coupling the base to the armor; and means for rigidly securing the adapter with the base.

In still yet another aspect of the invention, there is provided a kit for retrofitting a structure with armor, the kit comprising a base for attachment to the structure, an adapter for engagement with the base and with the armor for coupling the base to the armor, means for rigidly engaging the adapter with the base, and instructions for mounting the armor on the structure using the base, the adapter and the means for rigidly securing the adapter with the base.

With the present system, armor may be mounted on to any structure. Preferably, the structure is a vehicle hull, for example hulls of military and non-military vehicles. Military vehicles include, for example, trucks, jeeps, buses, personnel carriers, armored vehicles, etc. Non-military vehicles include cars, trucks, buses, etc.

The base preferably has a head portion and a stem portion, the head portion having a larger diameter than the stem portion. Preferably, the head portion will be engaged with the adapter and the stem portion will be attached to the structure. The base may be attached to the structure through the stem portion in any suitably rigid manner. For example, the base may be welded to, bolted to or screwed into the structure. If the base is to be welded to the structure, it is advantageous that the base further comprises a foot portion having a larger diameter than the stem portion in order to provide greater welding contact between the base and the structure. Where the structure has existing means for attachment to the stem portion of the base, a foot portion is not necessary. For example, if the structure has existing tapped pads, the stem portion may be threaded to engage directly with the tapped pad.

Adapters may be of any suitable size and shape. The nature of the armor to be mounted to the structure influences the size and shape of the adapter. For example, the adapter may be a wafer laminated between faces of composite armor or a spacer welded to spaced metallic armor. The adapter comprises means for receiving the base, preferably the head portion of the base. The means for receiving the base may include, for example, an aperture sized to receive the head portion of the base.

Means for rigidly securing the adapter to the base depends on the nature of the adapter. Some examples of the means for rigidly securing the adapter to the base include pins, bolts, etc.

The base, the adapter and the means for rigidly securing the adapter to the base are preferably made of durable, light-weight, corrosion resistant materials, for example composite, aluminum or steel fabrications. Light-weight, durable, corrosion resistant alloys are preferred, in particular steel or aluminum alloys.

The system of the present invention may be conveniently used with different types of armor, for example composite armor and spaced metallic armor. Composite armor generally comprises several layers of armor laminated together. One of the layers may be an anti-penetration layer.

The natures of the adapter and the means for rigidly engaging the adapter with the base may differ depending on the type of armor. Adapters may be laminated or placed within the armor between front and rear faces of the armor. Lamination of the adapter into composite armor advantageously does not require holes to be cut into the front face of armor panels, thereby increasing coverage area and ballistic effectiveness. Engagement of the adapter with the base occurs at the rear face of the armor so that the front face presents a generally smooth surface. Any number of adapters may be used with a single armor plate, however, it is advantageous to have enough adapters to securely mount the armor plate to the structure while not having so many that the integrity of the armor is unduly compromised. The appropriate number of adapters is influenced greatly by the size of the armor plate. Advantageously, the same base may be used to mount composite armor or spaced metallic armor, therefore, a single vehicle may be fitted with different kinds of armor at different times thereby increasing the versatility of the vehicle.

The system advantageously permits retrofitting of previously unarmored structures and/or permits replacement of damaged or obsolete armor. In a retrofitting operation, armor is constructed having adapters engaged therewith. Bases are attached to the structure and then the armor is mounted on the bases by engagement of the adapter with the base. Means for rigidly securing the adapter with the base are employed to ensure that the armor does not fall off the vehicle in operation. If replacement of the armor is desired, the system of the present invention permits easy replacement of the armor without needing to replace the structure. The armor to be replaced is dismounted from the structure by undoing the means for rigidly securing the adapters to the bases and then disengaging the adapters from the bases. New armor may then be mounted on to the existing bases as described above.

The system advantageously increases ballistic effectiveness by reducing the ballistic window through which projectiles may penetrate. Since the adapters used to mount the armor on a structure are covered by armor, the mounting points no longer create ballistic windows. The system further advantageously renders vehicles stealthier by reducing thermal emissions from the vehicle and by not reflecting radar as readily. The system yet further advantageously permits mounting of composite armor plates on uneven surfaces of structures since the mounting system compensates for the uneven surfaces.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1A:
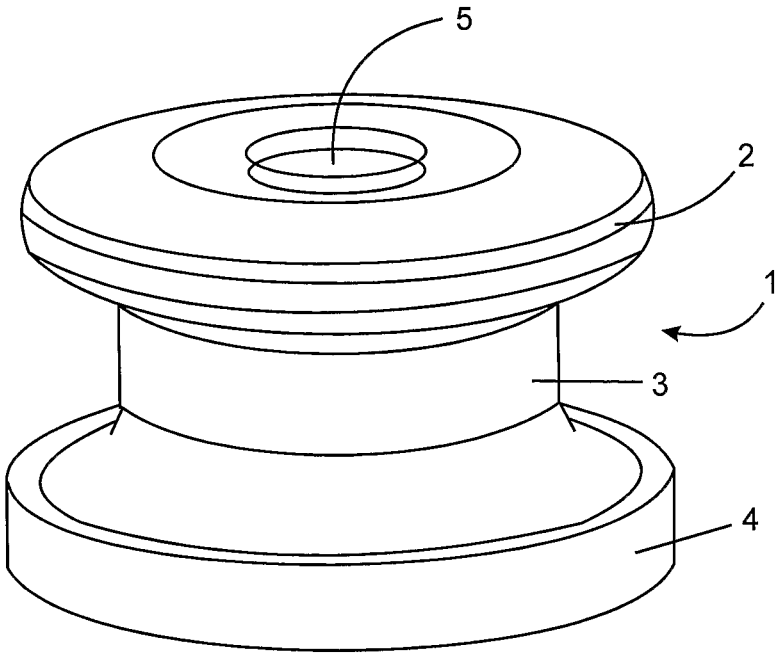
FIG. 1A is a perspective view of a first embodiment of a base useful in an armor mounting system of the present invention.
Figure 1B:
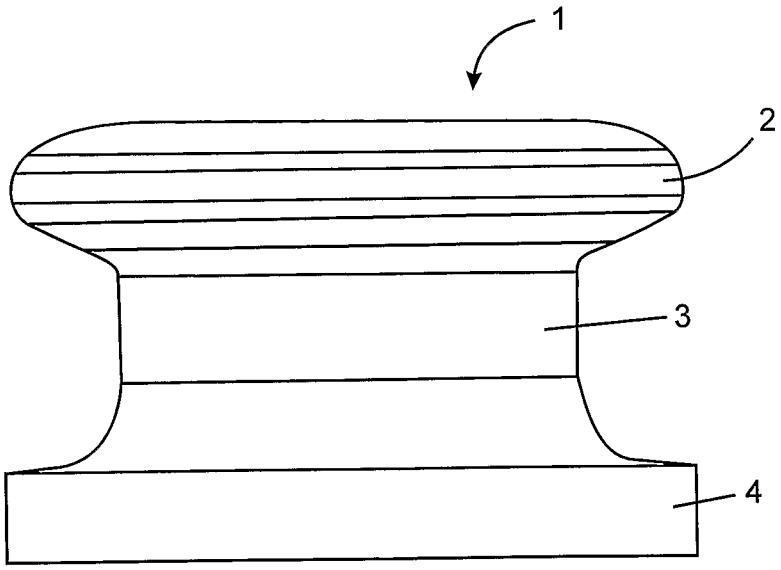
FIG. 1B is a side view of the base of FIG. 1A.

Referring to FIGS. 1A and 1B, base 1 is generally annular in shape and comprises head portion 2, stem portion 3 having a smaller diameter than head portion 2, and foot portion 4 having a larger diameter than stem portion 3. Threaded bore 5 receives a bolt for securing base 1 to an adapter in connection spaced metallic armor as described below in respect of FIGS. 8-10. Base 1 can be welded to a vehicle hull at foot portion 4.

Figure 2A:
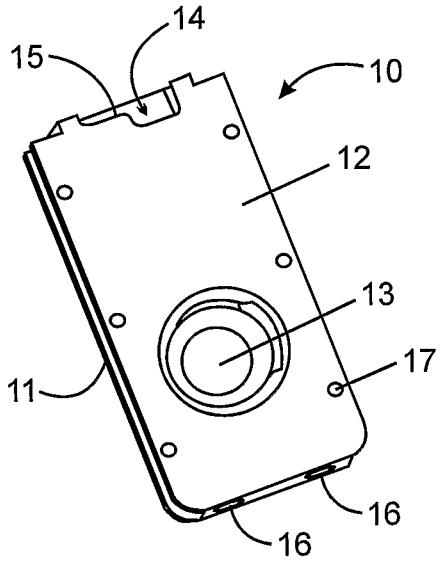
FIG. 2A is a rear perspective view of an adapter useful in a composite armor mounting system of the present invention.
Figure 2B:
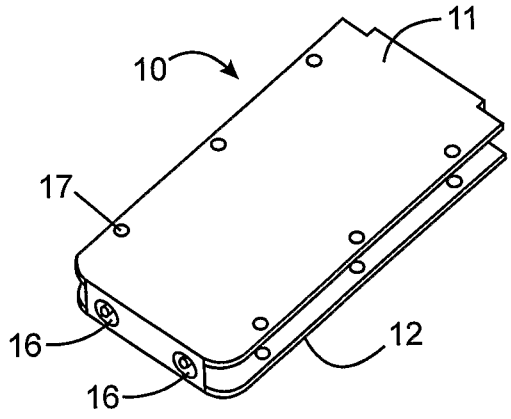
FIG. 2B is a front perspective view of the adapter of FIG. 2A.
Figure 2C:
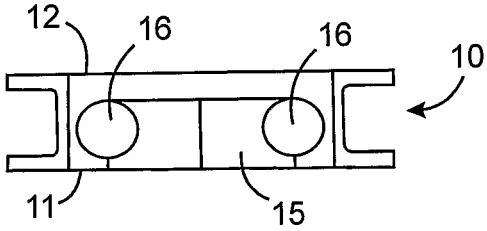
FIG. 2C is an end view of the adapter of FIG. 2A.

Referring to FIGS. 2A, 2B and 2C, generally wafer-like adapter 10 suitable for lamination into composite armor comprises front face 11 and rear face 12. Rear face 12 comprises mounting aperture 13 for engagement with the head portion of the base. Pin slot 14 at one end of adapter 10 receives a spring pin in a manner described in connection with FIGS. 4-6 which rigidly secures the head portion of the base within mounting aperture 13 of adapter 10. Pin stop 15 is positioned in pin slot 14 to provide optimal positioning of the spring pin just past top dead center. Pin stop 15 prevents the spring pin from sliding too far. Pin holes 16 are drilled all the way through adapter 10 during manufacture. Fastener holes 17 (only one labeled) permit the use of fasteners (e.g. rivets, screws, etc.) to further secure the adapter to the armor if desired.

Figure 3A:
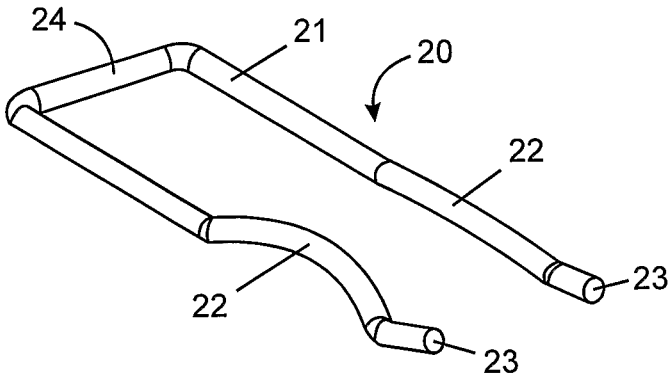
FIG. 3A is a perspective view of a spring pin for securing the adapter of FIG. 2A to the base of FIG. 1A.
Figure 3B:
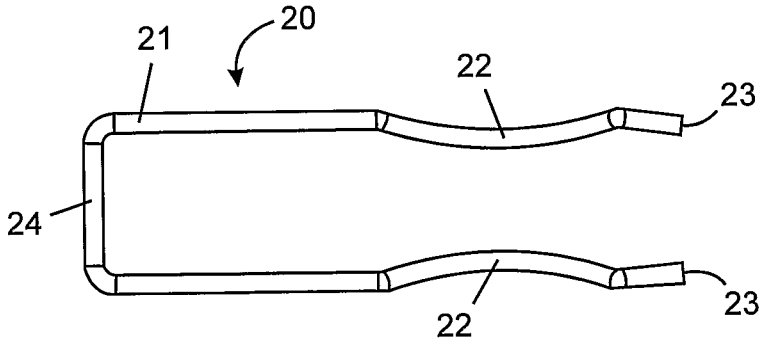
FIG. 3B is a top view of the spring pin of FIG. 3A.

Referring to FIGS. 3A and 3B, spring pin 20 suitable for rigidly securing adapter 10 (FIG. 2A) to base 1 (FIG. 1A) comprises a generally U-shaped rod 21 having curved portions 22 near tips 23 of rod 21. Curved portions 22 are curved inwardly in the plane of the "U" as best seen in FIG. 3B. Curved portions 22 are also curved out of the plane of the "U" as best seen in FIG. 3A, which could be either upwardly or downwardly depending on the orientation of the pin. Base of the "U" 24 is about as wide as the diameter of the stem portion of the base if FIG. 1A.

Figure 4:
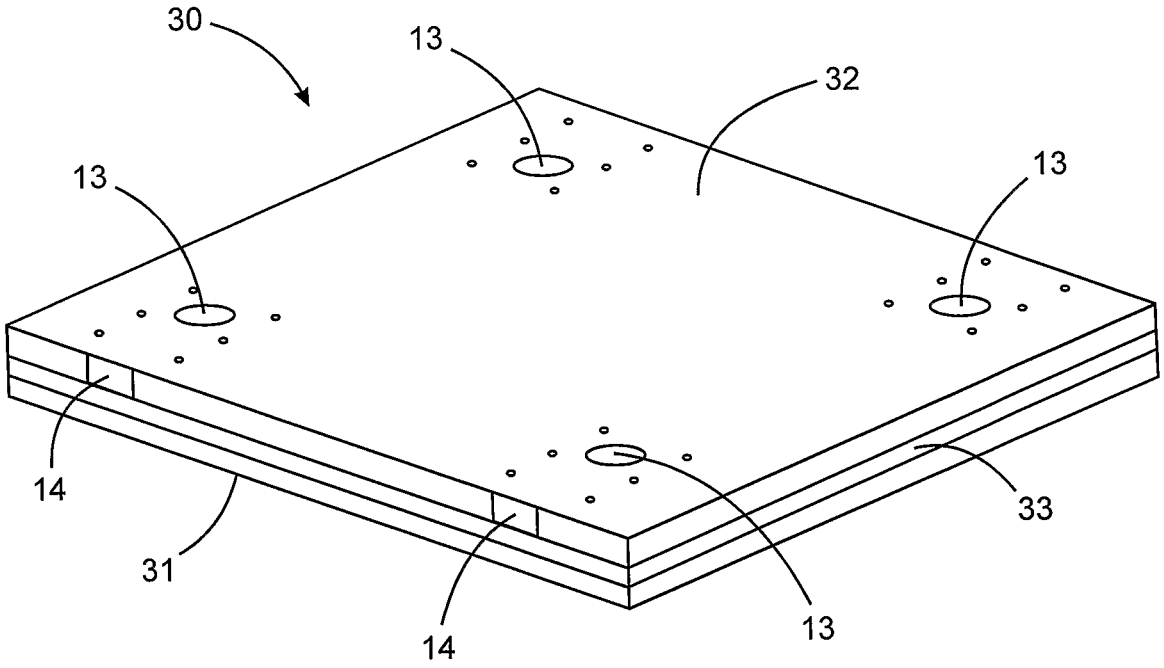
FIG. 4 is a perspective view of composite armor having four adapters of FIG. 2A laminated therein.

Referring to FIG. 4, composite armor plate 30 is shown having four adapters of FIG. 2A laminated between front face 31 and rear face 32 of the armor plate. The armor plate comprises several layers of armor including anti-penetration layer 33 overlying the adapters. Mounting apertures 13 are open at rear face 32. Pin slots 14 (only two shown) are open on opposed edges of armor plate 30.

Figure 5:
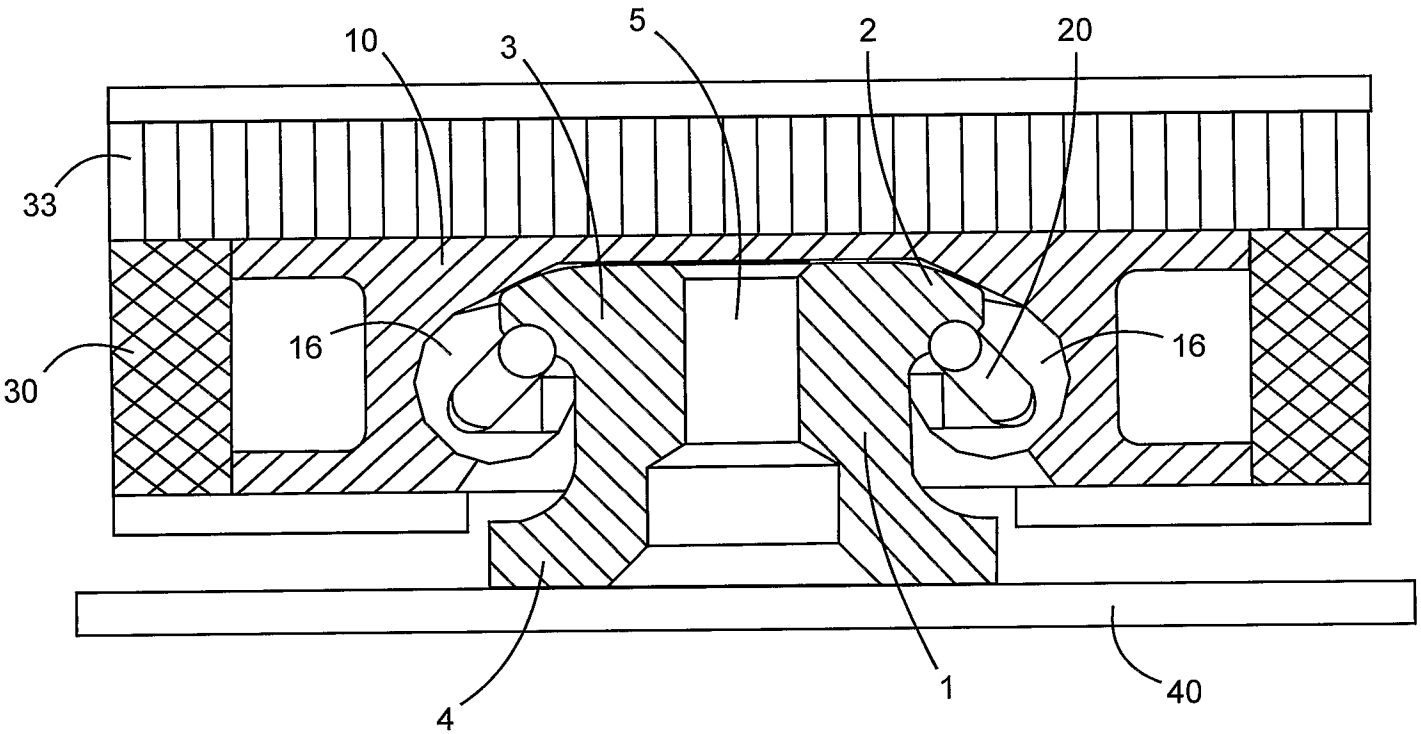
FIG. 5 is an end cross-sectional view through one section of the composite armor of FIG. 4 mounted on a vehicle hull to which the base of FIG. 1A is welded.

Referring to FIG. 5, a section of composite armor plate 30 of FIG. 4 is shown mounted on vehicle hull 40. Foot portion 4 of base 1 is welded to vehicle hull 40. Head portion 2 of base 1 is engaged within mounting aperture 13 of adapter 10 laminated within composite armor plate 30. Anti-penetration layer 33 of the composite armor plate overlies adapter 10. Therefore, anti-penetration layer 33 has no interruptions thereby reducing the ballistic window. Spring pin 20, as seen through pin holes 16 of adapter 10, rigidly secures head portion 2 of base 1 within mounting aperture 13 by exerting force both inwardly and upwardly at the underside of head portion 2 proximal stem portion 3. Inward and upward force exerted by spring pin 20 is a result of the curvature of the curved portions of spring pin 20. Threaded boss 5 plays no role in this embodiment and may be omitted if desired. The absence of bolts in this mounting system helps reduce damage to armor from over tightening of bolts during mounting.

Figure 6:
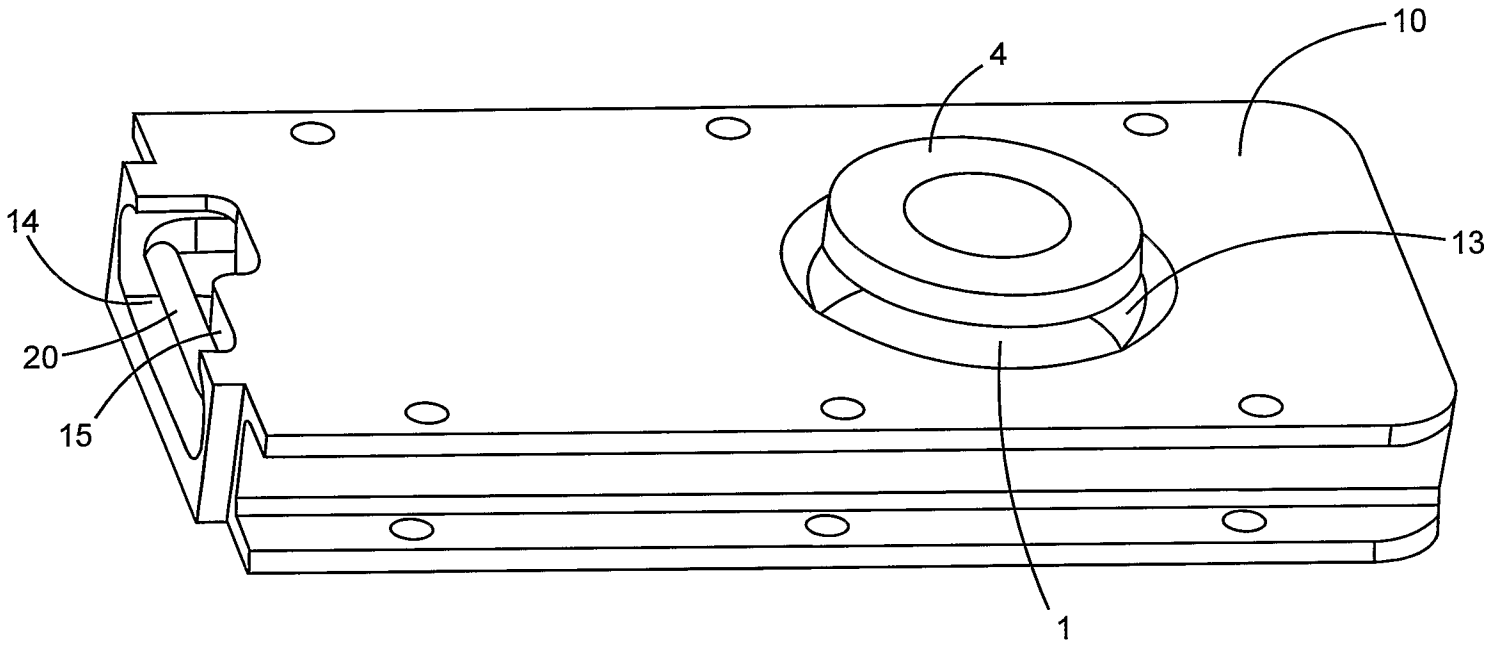
FIG. 6 is a rear perspective view of the base, adapter and spring pin of FIGS. 1-3 assembled in a system of the present invention.

Referring to FIG. 6, base 1, adapter 10 and spring pin 20 of FIGS. 1-3 are shown assembled in a mounting system of the present invention without the presence of the armor or vehicle hull. Spring pin 20 is slid through pin slot 14 with the aid of a rubber mallet since the spring pin exerts considerable force on base 1 to secure the base within mounting aperture 13. Pin stop 15 prevents the spring pin from sliding too far. Foot portion 4 of base 1 would be welded to the vehicle hull.

Figure 7:
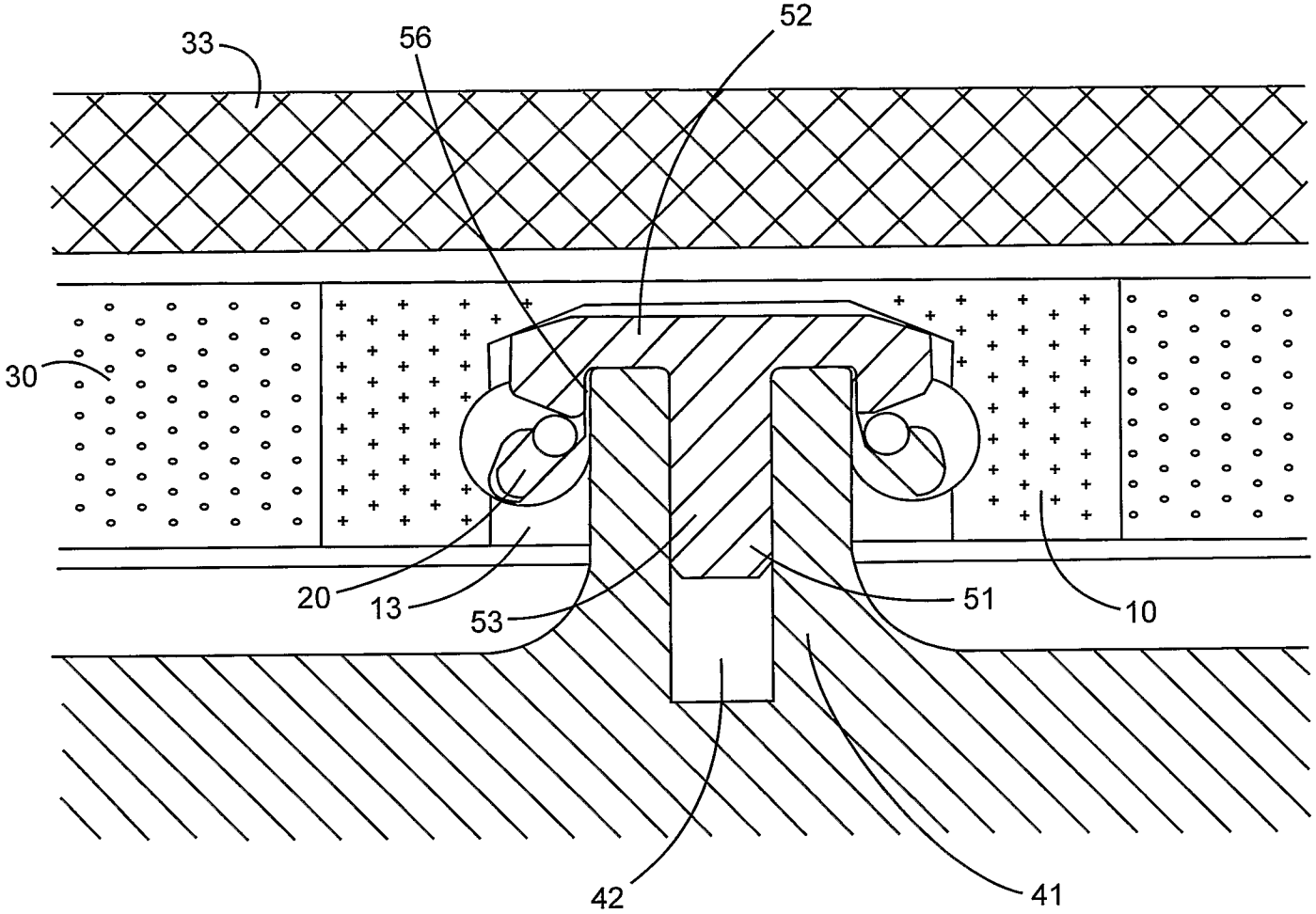
FIG. 7 is an end cross-sectional view of mounting system of the present invention having a second embodiment of a base mounted to an existing tapped pad on a vehicle hull.

Referring to FIG. 7, an existing generally annular tapped pad 41 welded to a vehicle hull (not shown) is utilized to attach base 51 to the vehicle hull. Base 51 comprises head portion 52 and stem portion 53, but no foot portion. Stem portion 53 is matingly threaded with corresponding threads on the inside wall of tapped pad 41. This permits base 51 to be screwed into bore 42 of tapped pad 41 to attach the base to the hull. In an alternate embodiment, the bore may be an existing part of the vehicle hull and the base may be screwed directly into the bore.

Still referring to FIG. 7, head portion 52 has generally annular channel 56, which fits over tapped pad 41. Adapter 10, laminated within composite armor plate 30, has mounting aperture 13, which engages head portion 52 of base 51. Spring pin 20 secures head portion 52 in mounting aperture 13 in a manner as described above in connection with FIG. 5. In this way, composite armor plate 30 is mounted on the vehicle hull.

Figure 8:
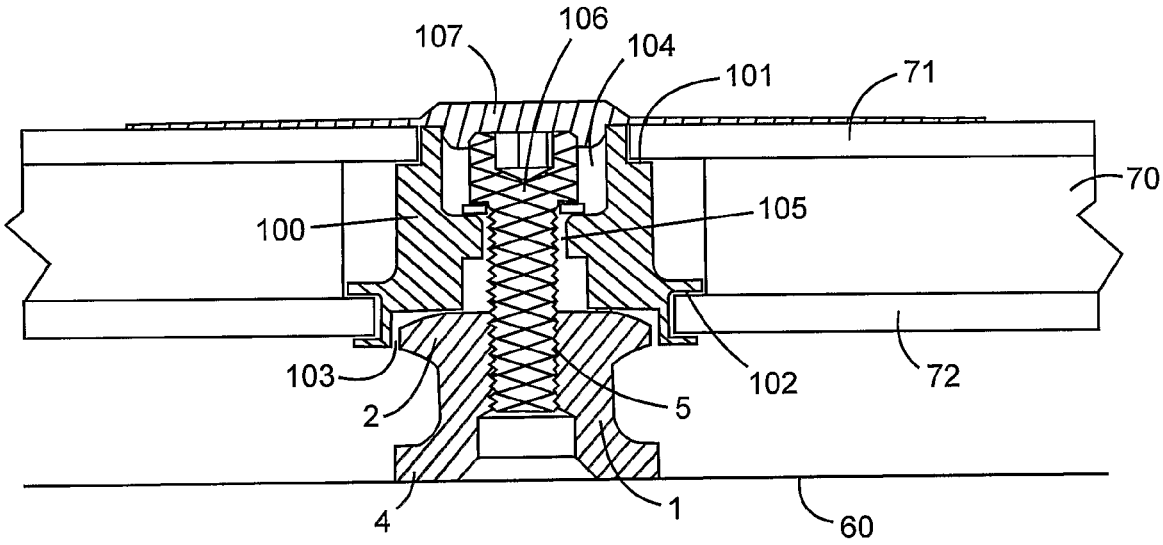
FIG. 8 is a side cross-sectional view of a spaced metallic armor mounting system of the present invention.

Referring to FIG. 8, a system for mounting spaced metallic armor is shown. Foot portion 4 of base 1 of FIG. 1 is welded to vehicle hull 60. Generally annular adapter 100 is welded to spaced metallic armor 70 between outside armor plate 71 and inside armor plate 72. Outside armor plate 71 is welded on first perimetrical lip 101 of adapter 100 and second perimetrical lip 102 of adapter 100 is bent around inside armor plate 72. Adapter 100 comprises generally annular base mounting aperture 103 for receiving head portion 2 of base 1 for mounting the armor on the vehicle hull. Adapter 100 has a central axially aligned bolt hole comprising bolt head seat 104 and bore 105. Bore 105 of adapter 100 aligns with threaded bore 5 of base 1 so that tap bolt 106 can be screwed in through bore 105 and threaded bore 5 to rigidly secure adapter 100 to base 1. Bolt cap 107 is inserted into bolt head seat 104 to protect tap bolt 106 from the elements. A single armor panel may have one or more systems of this nature for mounting the armor to the vehicle hull.

Figure 9:
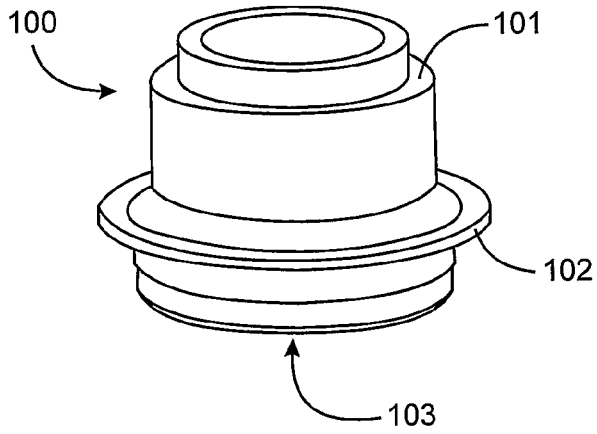
FIG. 9 is a perspective view of an adapter in the spaced metallic armor mounting system of FIG. 8.

Referring to FIG. 9, an enlarged perspective view of adapter 100 illustrates the generally annular shape including annular base mounting aperture 103, first perimetrical lip 101 and second perimetrical lip 102.

Figure 10:
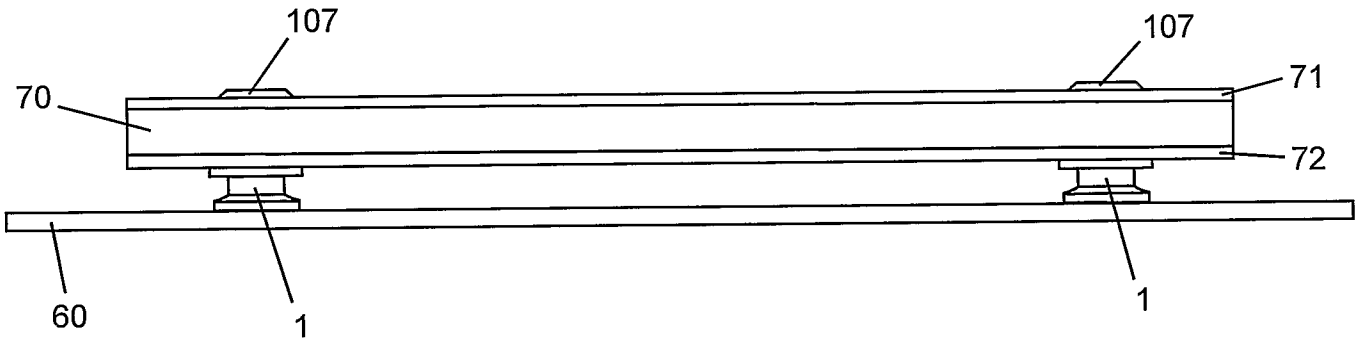
FIG. 10 is a side view of spaced metallic armor mounted to a vehicle hull with two of the mounting systems depicted in FIG. 8; and, FIG. 11A and FIG. 11B illustrate the appearance of the outside surfaces of composite armor and spaced metallic armor, respectively, when mounted on vehicle hulls using systems of the present invention.

Referring to FIG. 10, a side view of spaced metallic armor 70 mounted to vehicle hull 60 illustrates the use of two mounting systems depicted in FIG. 8. The adapters are located between outside armor plate 71 and inside armor plate 72 and are rigidly secured to bases 1 welded to vehicle hull 60. Bolt caps 107 are visible on the outer surface of armor 70.

Figure 11A:
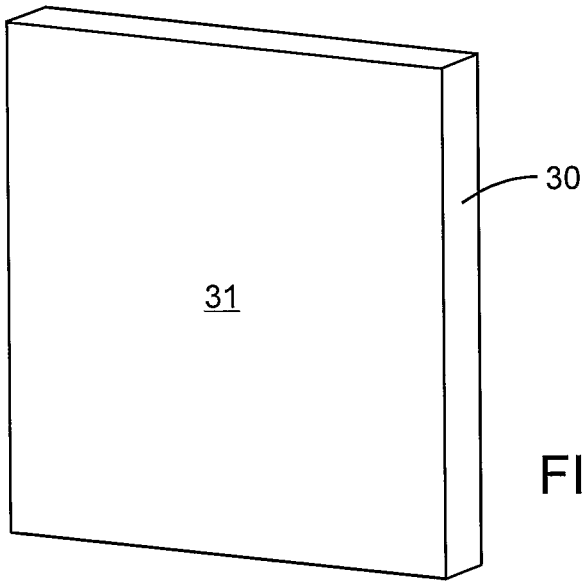
Figure 11B:
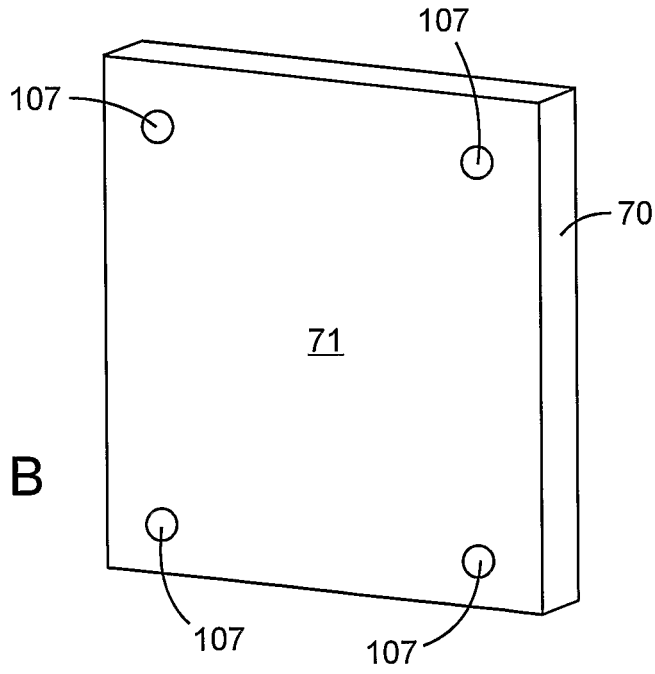

Referring to FIG. 11A, front face 31 (the outside surface) of composite armor 30 when mounted on a vehicle hull using the system described in connection with FIG. 5 or 7 presents a smooth unadorned appearance. Referring to FIG. 11B, the outside surface of outside armor plate 71 of spaced metallic armor 70 when mounted on a vehicle hull using the system described in connection with FIG. 8 presents a smooth unadorned appearance except for bolt caps 107 covering the tap bolts underneath.

Other advantages which are inherent to the structure are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

The invention claimed is:

1. A system for mounting, to a structure, armor having a strike surface for ballistic protection against penetration by projectiles, said armor having a rear face, edges and a thickness, comprising:

a base for attachment to the structure having a lock structure;

an adapter embedded within the thickness of the armor beneath the strike surface wherein the strike surface is an un-interrupted layer of armor, the adapter being laminated between the strike surface and the rear face, and engaged with the base through the rear face of the armor, for coupling the base to the armor; and a securing mechanism, having a key structure complementary to said lock structure;

the adapter being completely within the bounds of the armor;

the adapter having a first aperture for receiving the base and a second aperture extending through an edge of the armor for receiving the securing mechanism to engage said key structure with said lock structure of the base to rigidly secure the adapter with the base.

2. The system of claim 1, wherein:

the base has a head portion and a stem portion, the head portion having a larger diameter than the stem portion.

3. The system of claim 2, wherein:

the head portion is engaged with the adapter.

4. The system of claim 3, wherein:

the first aperture receives the head portion.

5. The system of claim 2, wherein:

the base has a foot portion, the stem portion connects the foot portion to the head portion, the foot portion has a larger diameter than the stem portion, and the foot portion is rigidly attachable to the structure.

6. The system of claim 5, wherein:

the foot portion is rigidly attachable by welding.

7. The system of claim 4, wherein:

the stem portion is threaded to engage with an existing engagement means on the structure.

8. The system of claim 1, wherein:

the base comprises a head portion and a stem portion, the head portion having a larger diameter than the stem portion, the adapter comprises a wafer having a spaced-apart first and second faces, spaced-apart first and second ends, the first face having the first aperture, for receiving the head portion, the first end having the second aperture, the second aperture being a pin slot, and the securing mechanism for rigidly securing the adapter with the base comprises a pin insertable through the pin slot to engage the head portion of the base within the first aperture to rigidly secure the adapter with the base.

9. The system of claim 8, wherein:

the pin comprises a spring pin comprising a U-shaped rod having two tips, the rod having curved portions near the tips, the curved portions curved both inwardly and outwardly.

10. The system of claim 9, wherein:

the adapter comprises a pin stop for preventing the pin from entering too far into the pin slot.

11. The system of claim 8, wherein:

the stem portion is threaded to engage with an existing engagement means on the structure.

* * * * *